United States Patent [19]

Raymond

[11] 3,983,551

[45] Sept. 28, 1976

[54] ALARM SYSTEM FOR COIN-OPERATED TELEPHONE

[75] Inventor: William R. Raymond, La Canada, Calif.

[73] Assignee: Theodore S. Hoffman, San Marino, Calif.

[22] Filed: July 15, 1974

[21] Appl. No.: 488,325

[52] U.S. Cl. ..... 340/276; 200/61.68; 200/321; 340/280

[51] Int. Cl.[2] ..... G08B 13/00

[58] Field of Search ..... 340/421, 393, 276, 274, 340/280; 116/8, 89, 86, 85; 194/44; 70/DIG. 49; 200/61.67, 61.79, 44, 61.68, 61.93, 321, 333, 334; 292/169.14, 169.17, 192; 179/6.3 R, 178, 189 R, 189 D

[56] References Cited

UNITED STATES PATENTS

| | | | |
|---|---|---|---|
| 2,866,181 | 12/1958 | Gordon | 340/276 |
| 3,402,405 | 9/1968 | Contreras | 340/274 |
| 3,579,222 | 5/1971 | Freeman | 200/61.93 |
| 3,696,410 | 10/1972 | Wetzel et al. | 340/393 |
| 3,714,643 | 1/1973 | Sosin et al. | 340/274 |
| 3,742,162 | 6/1973 | Wasemann | 200/61.79 |
| 3,768,087 | 10/1973 | Kaye et al. | 340/274 |
| 3,842,410 | 10/1974 | Gopperton | 340/274 |
| 3,851,325 | 11/1974 | Maged | 340/274 |

*Primary Examiner*—John W. Caldwell
*Assistant Examiner*—James J. Groody
*Attorney, Agent, or Firm*—John G. Mesaros

[57] ABSTRACT

An alarm system for locking receptacles having an actuating arm, such as a latch bolt, engaging a fixed portion of the receptacle, the system including a switch having an arm for engageably coacting with the actuating arm in the locked position, with the switch open. Upon removal of the actuating arm, by force or otherwise, the switch arm, which is normally biased to a closed position, is released to activate an alarm circuit which includes a power source and a horn or bell or the like. Retaining means are provided to engage the switch arm to maintan it against its bias to inactivate the alarm system when access to the locking receptacle is desired by an authorized person.

3 Claims, 4 Drawing Figures

ALARM SYSTEM FOR COIN-OPERATED TELEPHONE

BACKGROUND OF THE INVENTION

This invention relates to an alarm system, and more particularly to an alarm system for use with locking receptacles.

With the widespread use of coin-operated devices such as telephones and the like, coin boxes in the machines have been the target of thieves. This is especially true with coin operated telephones which are placed in locations which make them accessible around the clock. A coin-operated telephone, in addition to the locked coin box also has an upper locking portion of the housing which protects the electrical portion of the dialing mechanism. This mechanism likewise is a target for vandals and thieves.

SUMMARY OF THE INVENTION

In accordance with the invention, there is provided a miniature switch having a switch arm positioned within the housing adjacent the lock actuating arm engaging portion of the housing. The switch is mounted so that the actuating arm coacts with the switch arm to maintain the switch arm in a depressed or normally open position when the receptacle is locked. The switch is electrically connected in series with a power source and an alarm means, such as a horn or a bell, so that upon withdrawal of the actuating arm, by use of force or even with a key, the switch arm returns to its normally biased closed position to activate the alarm system. A pivotal retaining blade is provided on the switch mounting structure adjacent the free end of the switch arm for maintaining the arm in a depressed position to inactivate the alarm system during servicing or removal of the cash contents of the coin box.

Accordingly, it is an object of this invention to provide a new and improved alarm system for use with lockable receptacles having a lock with an actuating arm.

It is another object of this invention to provide an alarm system which is activated by forcible removal of the receptacle.

It is a further object of this invention to provide an alarm system which is concealable, compact and efficient with a minimum number of parts.

DESCRIPTION OF THE DRAWINGS

Other objects, features and advantages of the present invention will become apparent from the following detailed description of system when taken in conjunction with the accompanying drawings in which.

DESCRIPTION OF THE PREFERRED EMBODIMENT

Figure 1:
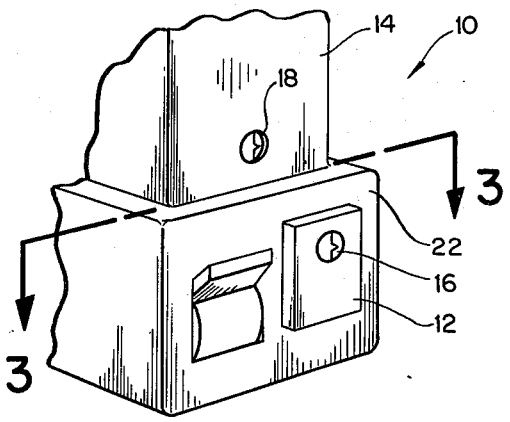
FIG. 1 is an isometric view (partially broken away) of a coin-operated telephone illustrating the two locking receptacles.

Referring now to the drawings and particularly to FIG. 1, there is shown a coin operated device such as a telephone housing 10 having a lower locking receptacle 12 such as a coin box, and an upper locking receptacle 14 which is removable to provide access to the electrical mechanism of the telephone. The lower receptacle 12 is a conventionally configured drawer type coin box which is slidably removable by use of a key inserted and operated in the keyhole 16. The upper receptacle 14 is basically a housing of box-like configuration without an end adjacent the locking edge. The receptacle 14 is removable by use of a key inserted into the keyhole 18.

Figure 2:
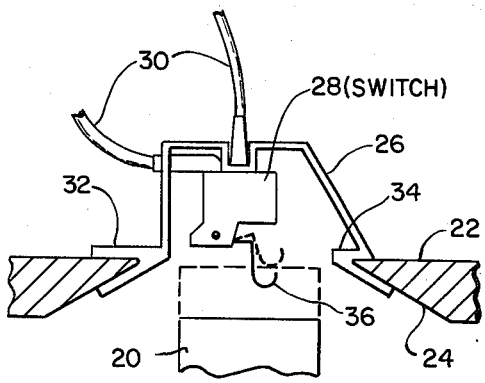
FIG. 2 is a partial cross-sectional view of a switch mounting assembly for use with the lower locking receptacle of the device of FIG. 1.

Both receptacles 12 and 14 have conventional locking mechanisms which are key-operated with a slidable actuating arm such as a latch bolt 20 (see FIG. 2) which engages a fixed recess or aperture in the mounted portion 22 of the telephone 10. FIG. 2 illustrates the locking arrangement by showing the latch bolt 20 with the dotted line immediately above indicating the extended or locked position thereof. The portion of the housing 22 illustrated is an inwardly-extending flange adjacent the upper edge of the opening into which the coin box 12 is inserted, it being understood that in front of this flange as viewed in FIG. 2 there is a portion of the housing 22 that engages the bolt 20 to prevent removal of the coin box 12 with the bolt 20 in its locked or dotted line position.

As shown in FIG. 2, the bolt 20 is slidably inserted within a cutout or recess 24. Mounted on the flange within the recess 24 is a miniature switch assembly which includes a mounting bracket 26 having fixedly mounted thereon a miniature switch 28 having a pair of electrical leads 30 extending therefrom. The mounting bracket 26 can be made, for example, from a resilient spring steel, and is of an inverted generally U-shaped configuration with flange engaging detents 32 and 34. For assembly of the mounting bracket 26 into the recess 24 the bracket 26 is inserted upwardly with the arms thereof bending under the force of the sidewalls of the recess 24 until the detents 32 and 34 snap over the corresponding edges of the flange of housing 22 within the recess 24.

The switch 28 is a conventional miniaturized switch which can be electrically connected to a normally open or normally closed position when the switch arm 36 is in its normally biased position shown in solid lines, that is, biased outwardly from the switch 28. The dotted line position of the switch arm 36 corresponds to its position when engaged by the locking mechanism actuating arm or latch bolt 20. In this system the switch 28 is electrically connected in the circuit with the switch 28 closed when the switch arm 36 is in its normally biased position shown in solid lines.

Figure 3:
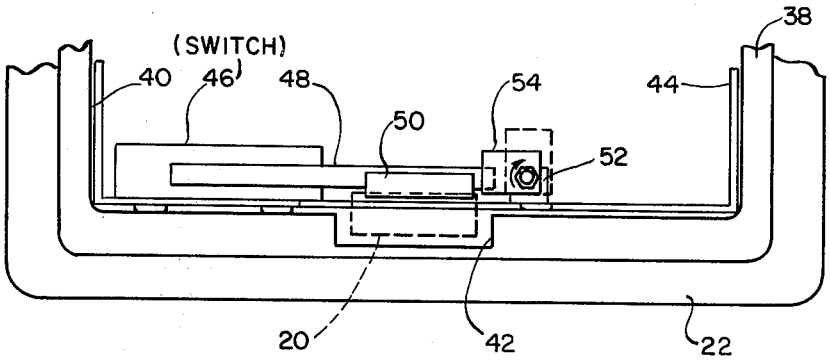
FIG. 3 is a top plan view partially broken away taken along lines 3—3 of FIG. 1 showing the switch mounting assembly for the upper locking receptacle of the device of FIG. 1.

Referring now to FIG. 3 the details pertaining to the upper locking receptacle will be described. The fixed or mounted portion 22 of the telephone 10 is provided with a reinforcing flange 38 about the periphery of the opening 40, the flange 38 having a recess 42 for engaging the bolt 20 (shown in dotted lines) for locking purposes. Mounted within the opening 40 is a generally U-shaped rigid mounting bracket 44 having secured thereto a switch 46 with a switch arm 48 extending into proximity to the recess 42 and correspondingly into proximity to the path of travel of bolt 20. An extending offset shoulder member 50 is secured to or an integral part of the switch arm 48 for coacting with the bolt 20 when extended. A projection 52 is secured to the inner surface of bracket 44 adjacent the free end of switch arm 48. Pivotally secured to the projection 52 is a retaining member 54 which is positioned and configured to retain the switch arm 48 in its depressed position (corresponding to the electrically open position) when an authorized serviceman is making repairs. During actual use as an alarm system with the upper receptacle 14 in place and locked the retaining member 54 is pivoted clockwise to the dotted line position out of engagement with the switch arm 48.

Figure 4:
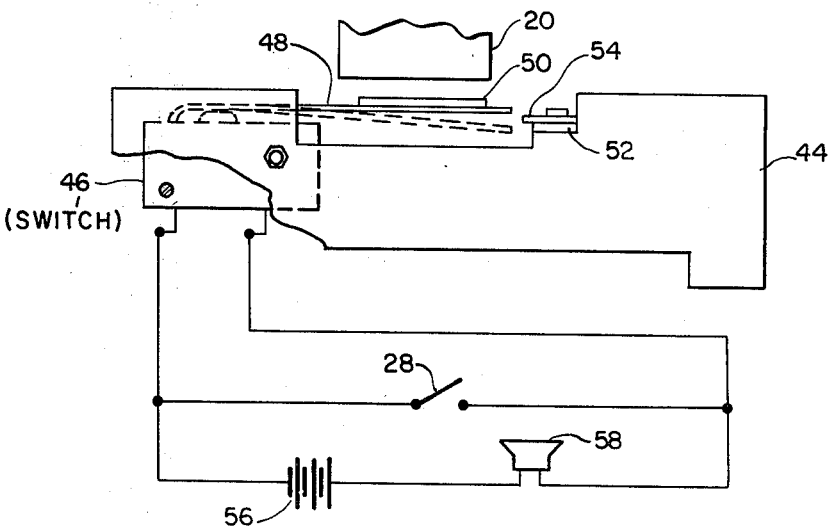
FIG. 4 is a front plan view of the mounting assembly of FIG. 3 with a schematic diagram of the electrical circuitry.

As shown in FIG. 4, the switch 46, with the switch arm 48 depressed (as shown in dotted lines) provides an open switch in series with a power source such as a battery 56 and an alarm such as a horn 58. Connected in parallel with switch 46 is the lower receptacle switch 28, shown schematically in the open position. Switches 46 and 28 are identical in function and operation although configured differently to accommodate available space within the housing. When entry is gained to either compartment, by force or otherwise, the lock assembly including the latch bolt 20 is removed with the so-removed receptacle or housing cover, thereby permitting the switch arm 36 or 48 to return to its normally biased position (shown in full lines) to electrically close the circuit and activate the alarm horn 58, to thereby frighten away the unauthorized intruder. An authorized person having knowledge of the system can deactivate either switch after gaining access with only a momentary sounding of the alarm.

Although the embodiment described shows an audible alarm means it is to be understood that any alarm means, such as a light or electronic silent alarms can be employed within the spirit of the invention and further the switches can be electrically closed or open with the switch arm depressed depending on the alarm means used. Consequently, while there has been shown and described a preferred embodiment various other adaptations and modifications may be made within the spirit and scope of the invention.

I claim:

1. An alarm system for use with a device having a housing and a removable portion releasably secured to the housing by means of a lock assembly affixed to the removable portion, said lock assembly having a latch bolt movable between a first position engaging a recess in said housing and a second position for releasing the removable portion, said system comprising:

switch means secured to said housing in proximity to said recess, said switch means having a switch arm positioned in the path of travel of said latch bolt, said switch arm being normally biased toward said latch bolt along said path and being operable against its bias by engaging said latch bolt when said latch bolt is being moved to said first position;

a power source;

alarm means;

electrical circuit means interconnecting said power source, said alarm means and said switch means, said switch means electrically connecting said power source to activate said alarm means only when said latch bolt is out of engagement with said switch arm; and manually operable retaining means for retaining said switch arm in a position against its bias when said actuating arm is out of engagement with said switch arm to inactivate said alarm system.

2. The combination according to claim 1 wherein said switch arm has a pivoted end and a free end, and said switch means includes a mounting bracket having said retaining means pivotally secured thereto adjacent the free end of said switch arm.

3. The combination according to claim 2 wherein said switch means is offset from the path of travel of said latch bolt and said switch arm has an offset member affixed thereto for engaging said latch bolt.

* * * * *